United States Patent [19]

Barker et al.

[11] 4,359,441

[45] Nov. 16, 1982

[54] POLYMERIC FILAMENTS AND PROCESS FOR FORMING SUCH MATERIAL

[75] Inventors: Ivan Barker; Geoffrey Marshall, both of Harrogate, England

[73] Assignee: Imperial Chemical Industries, Limited, London, England

[21] Appl. No.: 69,435

[22] Filed: Aug. 24, 1979

Related U.S. Application Data

[63] Continuation of Ser. No. 780,074, Mar. 22, 1977, abandoned.

[30] Foreign Application Priority Data

Mar. 23, 1976 [GB] United Kingdom ..... 11633/76

[51] Int. Cl.[3] ..... D01D 5/10

[52] U.S. Cl. ..... 264/176 F; 264/234

[58] Field of Search ..... 264/176 F, 234, 210.8, 264/210.5, 210.2, 210.3

[56] References Cited

U.S. PATENT DOCUMENTS

| | | | |
|---|---|---|---|
| 3,946,100 | 3/1976 | Davis et al. | 264/176 F |
| 3,994,121 | 11/1976 | Adams | 264/176 F |
| 4,000,238 | 12/1976 | Maurer | 264/234 |
| 4,195,161 | 7/1980 | Davis et al. | 264/176 F |

FOREIGN PATENT DOCUMENTS

| | | | |
|---|---|---|---|
| 45-1932 | 1/1970 | Japan | 264/210 F |
| 48-28012 | 8/1973 | Japan | 264/210.8 |
| 51-43424 | 4/1976 | Japan | 264/210.8 |
| 51-60728 | 5/1976 | Japan | 264/210.8 |
| 294874 | 3/1971 | U.S.S.R. | 264/237 |

*Primary Examiner*—Jay H. Woo

*Attorney, Agent, or Firm*—Herbert M. Adrian, Jr.

[57] ABSTRACT

Process and apparatus for modifying melt spun filaments after extrusion and solidification by tensioning and exposing to a heated fluid environment. By this invention it is possible to directly form a melt spinnable filamentary yarn having properties similar to those of drawn yarns.

11 Claims, 1 Drawing Figure

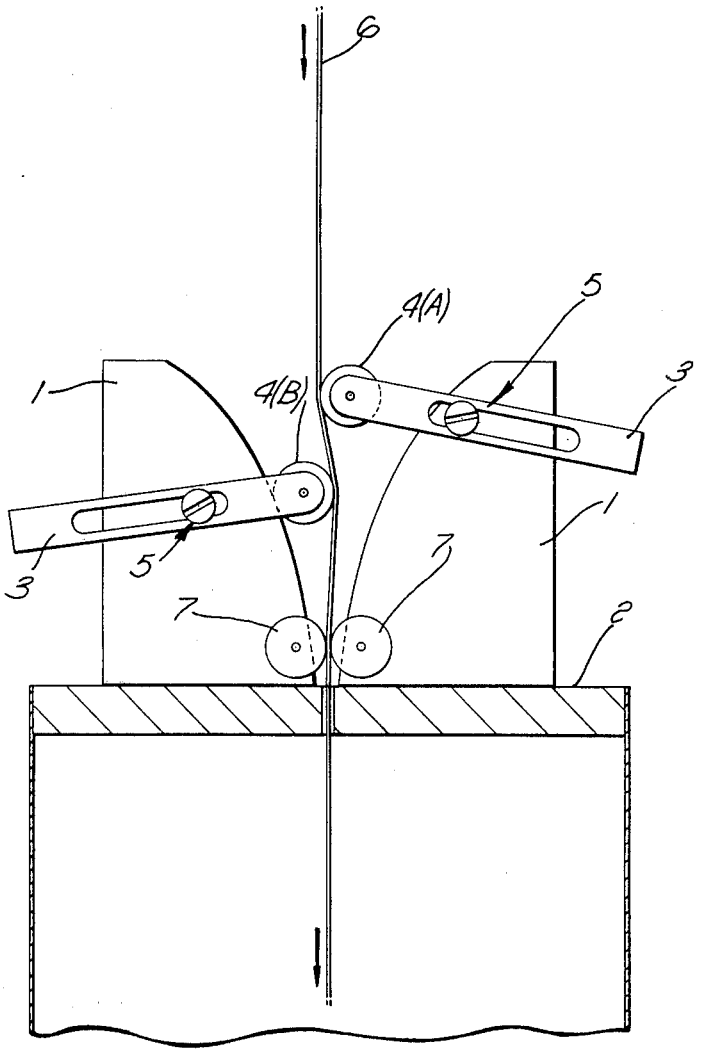
6
4(A)
5
3
1
4(B)
1
3
5
7
7
2

POLYMERIC FILAMENTS AND PROCESS FOR FORMING SUCH MATERIAL

This is a continuation of application Ser. No. 780,074, filed Mar. 22, 1977, now abandoned.

The present invention relates to polymeric filamentary material and more particularly to processes and apparatus for forming such materials.

The expression "filamentary material" embraces both multi- and monofilament yarns.

According to the present invention it is possible to directly form a melt spinnable polymeric filamentary yarn having properties similar to those of drawn yarns without the need to separately or additionally draw the filaments subsequent to winding-up after spinning.

In particular it has been found possible to advantageously modify melt spun filaments following extrusion and solidification thereof by exposing the filaments after tensioning to a heated fluid environment.

Thus the present invention provides a process for forming polymeric filamentary material comprising:

(a) extruding the polymeric material while molten to form filaments (b) advancing the molten filaments through a solidification zone (c) advancing the solidified filaments through a tensioning zone without inducing substantial drawing thereof within the zone (d) advancing the solidified filaments through a treatment zone into which fluid heated to a temperature above the glass-rubber transition temperature of the filaments is introduced (e) withdrawing the filaments from the treatment zone at a velocity of from 1000 meters/minute.

Features (a), (b) and (e) refer to conventional processes and are not, per se, considered to be novel. To achieve solidification the filaments are cooled to a temperature below their crystalline melting point and preferably below that of their softening point, still further preferably blow their glass-rubber transition temperature.

Preferably the tension in the tensioning zone should be insufficient to induce any drawing of the filaments within the zone, though a small amount of drawing can be tolerated, e.g. 3–4%, subject to the number of broken filaments it caused.

The tensioning zone may take the form of one or more guides with which the filaments come into contact. Preferably the guides are adjustable so that the angle of filament wrap may readily be changed. The guides are located close to the filament entry point into the treatment zone and such an arrangement is described in detail below. Alternative means for tensioning the solidified filaments include pneumatic means or the use of a water bath.

A treatment zone suitable for employment in the present invention may take the form of an elongate tube of circular or rectangular cross-section which is mounted vertically between the means for extruding the polymeric material and the means for withdrawing the filaments. The fluid, e.g. air, nitrogen or steam, but preferably air, which has previously been heated to a temperature above the glass-rubber transition temperature of the filaments is introduced into the tube at a point close to the entry point into the tube of the filaments, desirably within a distance of 25% of the total length of the tube below the filament entry point and preferably within a distance of 10% of that point.

Advantageously, the fluid is introduced into the tube in an upward direction, i.e. in the opposite direction to that of the advancing filaments, and this may be conveniently achieved by passing the fluid through a ring nozzle with baffle arrangement located in the wall of the tube.

Fluids heated to temperatures varying from 40° C. to 300° C. have been introduced into the treatment zone as exemplified below, but desirably the fluid should be heated to a temperature between the glass-rubber transition temperature and the melting point of the advancing filaments.

When the fluid is heated to a temperature above the melting point of the filaments, the temperature should not be so high as to cause excessive filament breaks, and care should also be taken to ensure that the advancing filaments do not accidentally come into contact with any hot parts of the treatment zone which may also cause them to break.

Preferably, the filaments are withdrawn from the treatment zone at velocities of from 1000 to 6000 meters/minute.

The present invention also provides an apparatus for forming polymeric filamentary material comprising:

(a) means for extruding the polymeric material while molten to form filaments (b) means for tensioning the filaments when solidified without inducing substantial drawing thereof by such tension (c) means for heating the filaments with a fluid heated to a temperature above the glass-rubber transition temperature thereof (d) means for withdrawing the filaments from means (c) at a velocity of from 1000 meters/minute.

Features (a) and (d) refer to conventional means and are not, per se, considered to be novel. Suitable means comprising two adjustable guides for tensioning the solidified filaments without inducing substantial drawing are diagrammatically illustrated in the accompanying figure which is a side elevation partly in section showing the filament entrance to the treatment zone. When employing this arrangement in the present invention the total angle of filament wrap, i.e. the sum of wrap angles on the two guides, should preferably lie in the range of 30°–270°.

Referring to the figure, the mounting 1 on top of the treatment tube 2 carries two adjustable guide holders 3 each of which has a cylindrical, non-rotatable ceramic guide pin 4 located at one end thereof (A and B). The position of each of the guide holders 3 is adjustable on the mounting 1 by means of a simple slot and screw arrangement 5 so that solidified filaments 6 may be tensioned as required by appropriate contact with the guides as illustrated prior to their entry into the treatment zone 2.

In addition to the guides described above, guides 7 (cylindrical and non-rotatable) defining a narrow slit may, optionally, also be employed to strip "cold" air from the advancing filaments and cause them to form a ribbon prior to their entry into the treatment zone. With large numbers of filaments "cold" air stripping and filament ribboning has been found to be particularly beneficial in assisting heat transfer in the treatment zone and stabilizing the filament bundle.

The treatment tube (not shown in detail) is partially closed at both filament entry and exit points to conserve its heated fluid atmosphere and further minimise the entry of "cold" air. A ring nozzle with baffle arrangement located at the upper end portion of the tube enables a circular, uniform flow of fluid to be introduced into the tube in an upward and opposite direction, opposite to that of the advancing filaments.

In all of the following Examples which are intended only to illustrate the present invention a treatment tube similar to that described above and shown in the accompanying drawing was used.

EXAMPLE 1

In a process for melt spinning a 500 filament yarn from molten polyethylene terephthalate (I.V. 0.675 dl/gm, extrusion temperature 276°–280° C.) employing a quench system similar to that described in UK patent application No. 938,056 to effect solidification of the filaments, a treatment tube about one meter in length and 7 cm in diameter was located (filamentary entry point) 2 meters below the means for filament extrusion. Air heated to temperatures between 150°–300° C. was introduced at about 50 cu.ft/minute in an upward direction into the tube through a ring nozzle and baffle arrangement located 20 cms from the filament entry point and the filaments were finally wound-up after the application of spin finish at a velocity of 3000 meters/minute.

The following comparative data was obtained:

| Arrangement | Filament tension gm/dtex | Treatment Tube Inlet Air Temp. °C. | Tenacity gm/dtex | Extension % | Shrinkage % |
|---|---|---|---|---|---|
| A. Tube absent | — | — | 1.9–2.1 | 100–110 | >38 |
| B. Tube without any guides | — | 290 | 2.4–2.6 | 70–80 | 10–30 |
| C. Tube with air stripping/ribbon guides only (3 inch. × ½ inch dia. 0.020 inch slit width) | 0.2 | 250–290 | 2.9–3.2 | 60 | 6–15 |
| D. Tube with air stripping/ribbon guides (0.020 inch slit width) and adjustable tensioning guides (4 inch × ½ inch dia.) Angle of filament wrap | | | | | |
| A 60° B 60° | 0.4 | 200–300 | 3.7–3.9 | 45–50 | 4–5 |
| A 90° B 180° | 0.8 | 230 | 4.7 | 30 | 4–5 |

For arrangement D filament draw-down in the tube was about ×2.25. The filaments (3.3 dtex) were found to exhibit properties typical of drawn yarns as distinct from those melt spun in similar conditions when employing arrangements A, B or C.

EXAMPLE 2

In this example a process and apparatus (arrangement D) similar to that described in Example 1 was employed to examine the effect of different angles of filament wrap on the tensioning guides in terms of yarn tenacity, extension and shrinkage. Unless otherwise stated process conditions are the same as that described in Example 1.

Yarn 1.7 decitex 640 filaments. Polymer throughput 22 kg/hour. Treatment tube inlet air temperature 260° C.

| Total angle of filament wrap° | Tenacity gm/dtex | Extension % | Shrinkage % |
|---|---|---|---|
| Air stripping/ ribbon guides only | 3.6 | 47 | 3.7 |
| 90 | 4.5 | 35 | 3.5 |
| 180 | 5.3 | 25 | 3.7 |
| 200 | 5.5 | 24 | 3.8 |

Yarn 1.7 decitex 1200 filaments. Polymer throughput 38 kg/hour. Air temperature 260° C.

| Total angle of filament wrap° | Tenacity gm/dtex | Extension % | Shrinkage % |
|---|---|---|---|
| 180 | 4.4 | 30 | 5.0 |
| 230 | 4.5 | 30 | 4.3 |
| 260 | 4.9 | 26 | 4.1 |
| 270 | 5.1 | 25 | 4.0 |

Yarn 3.3 decitex 504 filaments. Polymer throughput 31 kg/hour. Air temperature 260° C.

Air flow 70 cu.ft./min.

| Total angle of filament wrap° | Tenacity gm/dtex | Extension % | Shrinkage % |
|---|---|---|---|
| Air stripping/ ribbon guides only | 3.2 | 50 | 4.5 |
| 90 | 3.5 | 45 | 4.5 |
| 180 | 4.1 | 39 | 4.1 |
| 230 | 4.6 | 37 | 4.0 |
| 270 | 4.9 | 35 | 3.6 |

Yarn 13 decitex 120 filament. Polymer throughput 30 kg/hour. Air temperature 240° C.

Air flow 60 cu.ft./min.

| Total angle of filament wrap° | Tenacity gm/dtex | Extension % | Shrinkage % |
|---|---|---|---|
| Air stripping/ ribbon guides only | 3.0 | 86 | 4.0 |
| 90 | 3.4 | 77 | 3.4 |
| 105 | 3.5 | 67 | 3.6 |
| 140 | 3.6 | 65 | 4.5 |
| 160 | 3.6 | 53 | 4.3 |
| 220 | 3.8 | 50 | 4.9 |

This example shows that an increase in the angle of filament wrap produces a corresponding increase in tenacity and a decrease in extension to break. Also at higher wrap angles there is a small decrease in shrinkage as the wrap angle increases. With an increase in the number of filaments, i.e. an increase in polyester throughput, the angle of wrap to achieve a given tenacity also increases. Except where stated the processes and apparatus used in Examples 3, 4 and 5 are the same as those described in previous Examples 1 and 2.

EXAMPLE 3

The effect of the air temperature at the treatment tube inlet in terms of yarn tenacity, extension and shrinkage was investigated in this Example.

Yarn 3.3 decitex 504 filaments.

Total angle of filament wrap 30°-40°.

Air flow through tube 60 cu.ft./min.

| Air Temp °C. | Tenacity gm/dtex | Extension % | Shrinkage % |
|---|---|---|---|
| 40 | 2.2 | 87 | 31.0 |
| 60 | 2.7 | 81 | 38.0 |
| 80 | 2.6 | 108 | 43.0 |
| 120 | 3.0 | 122 | 69.0 |
| 140 | 3.3 | 74 | 58.0 |
| 150 | 3.2 | 55 | 30.0 |
| 160 | 3.6 | 60 | 13.0 |
| 170 | 3.5 | 53 | 9.0 |
| 180 | 3.6 | 61 | 6.0 |
| 200 | 3.8 | 64 | 5.4 |
| 220 | 3.7 | 66 | 4.1 |
| 240 | 3.8 | 60 | 4.0 |

The results demonstrate that yarn tenacity, extension and shrinkage are all dependent on air temperature up to about 200° C. Tenacity shows a steady increase from about 40° C. to 200° C. then flattens off. Extension and shrinkage increase from about 40° C. to 120° C. and then decrease, flattening out at approximately 200° C.

EXAMPLE 4

This example is similar to Example 3 except that air temperatures at the treatment tube inlet in the range 200° C.-260° C. were investigated for different air flows through the tube.

1.7 decitex 640 filament.

Total angle of filament wrap 230°.

| Air Temp. °C. | Air Flow cu.ft./min | Tenacity gm/dtex | Extension % | Shrinkage % |
|---|---|---|---|---|
| 200 | 60 | 4.8 | 20 | 5.2 |
| | 50 | 4.9 | 21 | 5.9 |
| | 40 | 4.5 | 23 | 6.6 |
| 240 | 60 | 5.2 | 25 | 4.2 |
| | 50 | 5.2 | 23 | 4.4 |
| | 40 | 4.9 | 25 | 4.5 |

-continued

| Air Temp. °C. | Air Flow cu.ft./min | Tenacity gm/dtex | Extension % | Shrinkage % |
|---|---|---|---|---|
| 260 | 60 | 5.4 | 21 | 3.8 |
| | 50 | 5.5 | 21 | 4.0 |
| | 40 | 5.4 | 25 | 4.4 |

3.3 decitex 640 filaments. Total angle of filament wrap 180°.

| Air Temp. 20 C. | Air Flow cu.ft./min | Tenacity gm/dtex | Extension % | Shrinkage % |
|---|---|---|---|---|
| 220 | 70 | 4.0 | 45 | 5.0 |
| | 60 | 4.0 | 43 | 5.0 |
| | 50 | 4.1 | 49 | 5.5 |
| | 40 | 3.9 | 49 | 6.5 |
| 240 | 70 | 4.6 | 45 | 4.3 |
| | 60 | 3.7 | 38 | 4.5 |
| | 50 | 4.1 | 50 | 4.8 |
| | 40 | 3.7 | 45 | 4.8 |
| 260 | 70 | 4.1 | 39 | 4.1 |
| | 60 | 4.2 | 47 | 4.3 |
| | 50 | 3.8 | 45 | 4.5 |
| | 40 | 4.2 | 44 | 4.7 |

13 decitex 120 filament. Total angle of filament wrap 140°.

Filament entry point of tube 2.3 meters below point of extrusion.

| Air Temp. °C. | Air Flow cu.ft./min | Tenacity gm/dtex | Extension % | Shrinkage % |
|---|---|---|---|---|
| 200 | 60 | 3.9 | 60 | 4.3 |
| | 50 | 3.7 | 59 | 4.0 |
| | 40 | 3.7 | 58 | 4.8 |
| 240 | 60 | 3.7 | 57 | 3.2 |
| | 50 | 3.6 | 60 | 4.5 |
| | 40 | 3.7 | 59 | 3.5 |

Within the temperature range 200° C.-260° C. only a small decrease in yarn shrinkage is evident as the temperature and air flow both increase. Yarn tenacity and extension remain substantially unchanged.

EXAMPLE 5

In this example the way in which yarn tenacity, extension and shrinkage vary with yarn wind-up speed was examined.

3.3 decitex 504 filaments. Total angle of filament wrap 230°. Treatment tube inlet air temperature 240°. Treatment tube inlet air temperature 240° C. Air flow through the tube 60 cu.ft./min.

| Wind up speed m/min. | Tenacity gm/dtex | Extension % | Shrinkage % |
|---|---|---|---|
| 3,000 | 4.5 | 30 | 4.5 |
| 2,500 | 4.3 | 31 | 3.9 |
| 2,000 | 4.2 | 40 | 3.3 |
| 1,500 | 3.8 | 43 | 2.7 |
| 1,000 | 3.4 | 51 | 2.2 |

13 decitex 120 filaments. Total angle of wrap 180°.

Air temperature 240° C. Air flow 60 cu.ft./min.

Filament entry point of tube 2.3 meters below point of extrusion.

| Wind up Speed m/min. | Tenacity gm/dtex | Extension % | Shrinkage % |
|---|---|---|---|
| 3,000 | 3.8 | 58 | 4.0 |
| 2,500 | 3.4 | 64 | 3.9 |
| 2,000 | 3.1 | 84 | 3.5 |

3.3 decitex 425 filaments (polymer I.V. 0.425 dl/gm). Total angle of wrap 85°. Air temperature 240° C. Air flow 40 cu.ft./min.

| Wind up Speed m/min. | Tenacity gm/dtex | Extension % | Shrinkage % |
|---|---|---|---|
| 4,600 | 3.1 | 27 | 6.5 |
| 4,000 | 3.0 | 34 | 5.2 |
| 3,500 | 2.9 | 47 | 4.8 |
| 3,000 | 2.8 | 60 | 4.3 |
| 2,500 | 2.6 | 59 | 4.1 |

These results clearly indicate the dependance of yarn tenacity, extrusion and shrinkage on wind up speed. Both yarn tenacity and shrinkage increasing with increasing wind up speed while extrusion falls.

EXAMPLE 6

Whereas previous Examples 1–5 have been directed to the behaviour of a polyester yarn, this example examines the effect of the present invention on nylon yarns derived from polyhexamethylene adipamide (conventionally melt spun and quenched).

In the absence of yarn tensioning guides (air stripping/ribbon guides only).

3.3 decitex 425 filaments. Treatment tube inlet air temperature 220° C. Air flow through the tube 60 cu.ft./min.

| Wind up speed m/min. | Tenacity gm/dtex | Extension % | Shrinkage % |
|---|---|---|---|
| 3,000 | 3.4 | 87 | 0.81 |
| 2,500 | 3.3 | 89 | approx. 1% extension |
| 2,000 | 3.2 | 115 | approx. 2% extension |

When using yarn tensioning guides:

3.3 decitex 425 filaments. Total angle of filament wrap 40°. Air flow 70 cu.ft./min. Wind up speed 3000 m./min.

| Air Temp. °C. | Tenacity gm/dtex | Extension % | Shrinkage % |
|---|---|---|---|
| 240 | 4.7 | 59 | 3.0 |
| 220 | 4.3 | 76 | 3.0 |
| 200 | 3.7 | 86 | 2.1 |
| 180 | 3.8 | 92 | 1.6 |

-continued

| Air Temp. °C. | Tenacity gm/dtex | Extension % | Shrinkage % |
|---|---|---|---|
| 150 | 3.6 | 85 | 0.23 |

These results demonstrate the value, particularly in terms of yarn tenacity, of using yarn tensioning guides especially at higher air temperatures.

What we claim is:

1. A process for forming polyethylene terephthalate filamentary material comprising:

(a) extruding the polyethylene terephthalate while molten to form filaments;

(b) advancing the molten filaments through a solidification zone;

(c) advancing the solidified filaments through a tensioning zone comprising one or more non-rotatable filament contact guides without inducing substantial drawing thereof within the zone;

(d) advancing the solidified filaments through a subsequent treatment zone into which fluid heated to a temperature above the glass-transition temperature of the filaments is introduced into the treatment zone at a point close to the entry point of the filaments into the zone;

(e) withdrawing the filaments from the treatment zone at a velocity of from 1000 to 6000 meters/minute.

2. A process as claimed in claim 1 wherein polymeric material is extruded at the rate of 20–38 kilograms/hour.

3. A process as claimed in claim 1 wherein the advancing molten filaments are solidified by cooling to a temperature below their crystalline melting point.

4. A process as claimed in claim 1 wherein the advancing molten filaments are solidified by cooling to a temperature below their softening point.

5. A process as claimed in claim 1 wherein the advancing molten filaments are solidified by cooling to a temperature below their glass-rubber transition temperature.

6. A process as claimed in claim 1 wherein the tension in the tensioning zone is insufficient to induce any drawing of the filaments within the zone.

7. A process as claimed in claim 1 wherein the fluid is introduced into the treatment zone within a distance of 25% of the total length of the zone below the filament entry point.

8. A process as claimed in claim 7 wherein the fluid is introduced into the treatment zone within a distance of 10%of the total length of the zone below the filament entry point.

9. A process as claimed in claim 1 wherein the fluid introduced into the treatment zone is air.

10. A process as claimed in claim 9 wherein the air is heated to a temperature of between the glass-rubber transition temperature of the filaments and 300° C.

11. A process as claimed in claim 9 wherein the air is heated to a temperature of between the glass-rubber transition temperature of the filaments and their melting point.

* * * * *